US011718942B2

(12) United States Patent
Fu et al.

(10) Patent No.: US 11,718,942 B2
(45) Date of Patent: Aug. 8, 2023

(54) DELAYED-CURE DURABLE PRESS FINISHING TECHNOLOGY FOR COTTON FABRICS

(71) Applicant: Jiangnan University, Wuxi (CN)

(72) Inventors: Jiajia Fu, Wuxi (CN); Weidong Gao, Wuxi (CN); Zhenyue Liu, Wuxi (CN); Xuerong Fan, Wuxi (CN); Lei Wang, Wuxi (CN); Yuzheng Lu, Wuxi (CN); Chaoran Meng, Wuxi (CN); Rong Li, Wuxi (CN)

(73) Assignee: JIANGNAN UNIVERSITY, Wuxi (CN)

( * ) Notice: Subject to any disclaimer, the term of this patent is extended or adjusted under 35 U.S.C. 154(b) by 0 days.

(21) Appl. No.: 17/897,473

(22) Filed: Aug. 29, 2022

(65) Prior Publication Data

US 2023/0002948 A1 Jan. 5, 2023

Related U.S. Application Data

(63) Continuation of application No. PCT/CN2022/097087, filed on Jun. 6, 2022.

(30) Foreign Application Priority Data

Jun. 28, 2021 (CN) ..... 202110720726.2

(51) Int. Cl.
*D06C 27/00* (2006.01)
*D06C 9/00* (2006.01)

(52) U.S. Cl.
CPC ..... *D06C 27/00* (2013.01); *D06C 9/00* (2013.01); *D06C 2700/135* (2013.01); *D10B 2201/02* (2013.01)

(58) Field of Classification Search
CPC .... D06C 27/00; D06C 9/00; D06C 2700/135; D10B 2201/02
See application file for complete search history.

(56) References Cited

U.S. PATENT DOCUMENTS

2001/0052193 A1* 12/2001 Payet ..... D06M 13/127 34/444
2010/0011482 A1* 1/2010 Chang ..... D06M 13/342 2/116

FOREIGN PATENT DOCUMENTS

| | | | | | |
|---|---|---|---|---|---|
| CN | 101220555 B | * | 7/2008 | ..... | D06B 3/18 |
| CN | 104195823 A | | 12/2014 | | |
| CN | 107938219 | * | 4/2018 | ..... | D06B 15/00 |
| CN | 107938219 A | | 4/2018 | | |
| CN | 108517689 A | | 9/2018 | | |
| CN | 112921662 A | | 6/2021 | | |
| CN | 113236292 A | | 8/2021 | | |
| WO | WO2018/026368 | * | 2/2018 | ..... | D06B 3/10 |

OTHER PUBLICATIONS

Wanping Zhu et. al. "Evaluation of the style of different finished cotton fabrics based on PhabrOmeter" Printing and Dying, Jan. 20, 2021 Issue 1. p. 11-14.

* cited by examiner

*Primary Examiner* — Amina S Khan
(74) *Attorney, Agent, or Firm* — IPro, PLLC; Na Xu

(57) ABSTRACT

The disclosure relates to the technical field of after-finishing of textile products, and in particular relates to a delayed-cure durable press finishing technology for cotton fabrics, including the following steps: singeing, desizing, liquid ammonia finishing, mercerizing, liquid ammonia finishing and post-cure finishing. The disclosure significantly improves the stability of a delayed-cure sensitized fabric during delayed-curing, relieves the problems caused by a slow reaction in the storage process of the delayed-cure sensitized fabric, and is favorable for improving the product quality.

3 Claims, No Drawings

DELAYED-CURE DURABLE PRESS FINISHING TECHNOLOGY FOR COTTON FABRICS

TECHNICAL FIELD

The disclosure relates to the technical field of after-finishing of textile products, and in particular relates to a delayed-cure durable press finishing technology for cotton fabrics.

BACKGROUND

As a soft and breathable fabric, cotton fabrics have the defects of easy wrinkling and deformation. These defects of cotton fabrics can be solved by effective technological methods such as durable press finishing and liquid ammonia finishing. Pre-cure durable press, wet-state durable press, post-cure durable press, durable press for ready-made clothes, and the like are representative finishing methods in durable press finishing. Among them, the delayed-cure method is a durable press finishing technology that is conducive to obtaining a more favorable setting effect for garments, but low stability of delayed-cure sensitized fabrics prepared by the technology has always been a crucial problem in technological development. The specific manifestation is that a partial cross-linking reaction occurs between cotton fabrics and resin during storage and transportation, resulting in wrinkles that are difficult to remove, and reducing the whiteness of the delayed-cure sensitized fabrics.

In the prior art, people mostly improve the storage stability of delayed-cure sensitized fabrics by designing and optimizing resin finishing agents and catalytic systems, and there is no report any literature that optimizes the finishing technology to achieve the aforementioned improvement effect.

SUMMARY

The objective of this section is to outline some aspects of examples of the disclosure and to briefly introduce some preferred examples. Some simplifications or omissions may be made in this section and the abstract and title of the application to avoid obscuring the objective of this section and the abstract and title, and such simplifications or omissions may not be used to limit the scope of the disclosure.

To solve the above-mentioned technical problem, the disclosure provides the following technical solution:

As a first aspect of the disclosure, the disclosure provides a delayed-cure durable press finishing technology for cotton fabrics, sequentially including the following processes: singeing, desizing, liquid ammonia finishing, mercerizing, liquid ammonia finishing and post-cure finishing, wherein the specific flow of the post-cure finishing process includes cotton fabric padding and pre-cure.

As an embodiment of the disclosure, the disclosure provides a delayed-cure durable press finishing technology for cotton fabrics, sequentially including the following processes: singeing, desizing, liquid ammonia finishing, mercerizing, liquid ammonia finishing and post-cure finishing, wherein the specific flow of the post-cure finishing process includes cotton fabric padding, pre-cure, storage and cure.

As an embodiment of the disclosure, in the post-cure finishing process, the curing temperature is 140-160° C., and the curing duration is 3-6 min.

As an embodiment of the disclosure, in the post-cure finishing process, pre-curing is performed at 80-85° C. (preferably 80° C.) for 2-3 min (preferably 3 min) to obtain a delayed-cure sensitized fabric with a moisture regain at doffing of 7-9% (preferably 8%).

As an embodiment of the disclosure, in the post-cure finishing process, the fabric pick-up rate after the cotton fabric padding is 70-90%.

As an embodiment of the disclosure, in the post-cure finishing process, a double-dip-double-nip padding method is used for padding the cotton fabric.

As an embodiment of the disclosure, the specific flow of the liquid ammonia finishing process includes fabric feeding, pre-cure, cooling, liquid ammonia treatment, steaming, water washing and drying.

As an embodiment of the disclosure, the liquid ammonia treatment step in the liquid ammonia finishing process includes padding with liquid ammonia for 13-17 s (preferably 15 s) and drying.

As an embodiment of the disclosure, the steaming temperature in the liquid ammonia finishing process is 90-100° C. (preferably 95° C.); and/or the water washing temperature in the liquid ammonia finishing process is 90-100° C. (preferably 95° C.).

As an embodiment of the disclosure, in the liquid ammonia finishing process, the speed is 50-60 m/min, the temperature of a treatment chamber is 80° C., and the pH value at doffing is 6.

As an embodiment of the disclosure, the specific flow of the mercerizing process includes: immersing a fabric in an alkaline solution, water washing, and adjusting the pH value of a neutralizing water washing tank to neutral.

As an embodiment of the disclosure, in the mercerizing process, the fabric is immersed in the alkaline solution for 4-6 min (preferably 5 min).

As an embodiment of the disclosure, the water washing in the mercerizing process is performed with tension applied at a temperature of 90-100° C. (preferably 95° C.).

As an embodiment of the disclosure, in the mercerizing process, the speed is 60-70 m/min (preferably 70 m/min), and the pH value of the neutralizing water washing tank is 4.5-5.0.

As an embodiment of the disclosure, the specific flow of the desizing process includes immersing a cotton fabric in an enzyme solution, steaming, water washing and drying.

As an embodiment of the disclosure, the steaming in the desizing process is performed by piling up at 100° C. for 20 min.

As an embodiment of the disclosure, the water washing temperature in the desizing process is 90-100° C. (preferably 95° C.).

As an embodiment of the disclosure, the desizing process is performed in the presence of a desizing enzyme (3 g/L), a penetrant (4 g/L) and a chelating agent (2 g/L), at a speed of 60-70 m/min (preferably 70 m/min).

As a second aspect of the disclosure, the disclosure provides a delayed-cure fabric product obtained by the aforementioned delayed-cure durable press finishing technology for cotton fabrics.

As a third aspect of the disclosure, the disclosure provides an application of the aforementioned delayed-cure fabric product in durable press garments.

The technical solution of the disclosure has the following advantages and effects:

(1) The disclosure creatively proposes to improve the storage stability of a delayed-cure sensitized fabric by optimizing a finishing technology. Specifically, a liquid ammonia finishing and mercerizing combined process (i.e. singeing, desizing, liquid ammonia finishing, mercerizing, liquid ammonia finishing and post-cure finishing) in a specific sequence is designed before a post-cure finishing process, and on the premise of not changing the technological parameters of individual processes, the storage stability of the treated delayed-cure sensitized fabric is significantly improved. The disclosure overcomes the technical bias in the field of cotton fabric finishing in the prior art that, to improve the storage stability of delayed-cure sensitized fabrics, often the technical means of resin finishing agents and catalytic systems are designed and optimized, while the influence of the relative sequence of processes in the pretreatment technology of post-cure finishing is hardly considered on the storage stability of delayed-cure sensitized fabrics. The disclosure solves the aforementioned technical problem just by the technical means abandoned due to technical bias.

(2) The disclosure achieves unexpected technical effects. The disclosure combines the pretreatment technology of "singeing, desizing, liquid ammonia finishing, mercerizing and liquid ammonia finishing" in a specific sequence with "post-cure finishing" (excluding storage and cure steps), significantly enhances the storage stability of delayed-cure sensitized fabrics, relieves the problems such as wrinkles that are difficult to remove and whiteness reduction caused by a slow reaction of the delayed-cure sensitized fabrics during storage, and is favorable for improving the product quality. The specific manifestation is that the delayed-cure sensitized fabric prepared by the disclosure has a relatively slowly changing overall breaking strength after 5 d of storage, a relatively slowly increasing overall wrinkle recovery angle, and always the highest whiteness. The pretreatment technology of "singeing, desizing, liquid ammonia finishing, mercerizing and liquid ammonia finishing" and "post-cure finishing" provided by the disclosure are well combined. When one process is omitted or the pretreatment technology sequence is changed, the stability of the prepared delayed-cure sensitized fabric obviously decreases.

(3) After the pretreatment technology of "singeing, desizing, liquid ammonia finishing, mercerizing and liquid ammonia finishing" and "post-cure finishing" (including storage and cure steps) as described in the disclosure are combined, compared with the single pretreatment technology of "singeing, desizing, liquid ammonia finishing, mercerizing, liquid ammonia finishing, tentering and preshrinking", the wrinkle recovery angle of the prepared cotton fabric increases by 32.5%, the wrinkle recovery performance is greatly improved, the breaking strength retention rate can reach 87.8%, and the durable press effect is more favorable.

(4) The treatment technology of the disclosure is relatively simple and feasible, and is suitable for industrialized large-scale production.

DETAILED DESCRIPTION

To make the objectives, features and advantages of the disclosure more obvious and easier to understand, the disclosure will be described in detail below with reference to the examples in the specification.

Numerous specific details are set forth in the following description to facilitate a full understanding of the disclosure, but the disclosure may also be practiced in other ways than those described herein. Those skilled in the art can make similar promotions without departing from the connotation of the disclosure, so the disclosure is not limited by the specific examples disclosed below.

Moreover, reference herein to "one example" or "examples" refers to a particular feature, structure, or characteristic that may be included in at least one embodiment of the disclosure. The appearances of "in one example" in different parts of this specification are not all referring to the same example, nor are they separate or selectively mutually exclusive from other examples.

The raw materials used in the examples and comparative examples of the disclosure are white plain cotton fabrics (120/70 ends/picks per 10 cm).

Example 1

A Delayed-Cure Sensitized Fabric, Prepared by a Technology Excluding Storage and Cure Steps A delayed-cure durable press finishing technology for cotton fabrics includes a pretreatment process and a post-treatment process.

The pretreatment process includes singeing, desizing, liquid ammonia finishing, mercerizing and liquid ammonia finishing.

The specific flow of the desizing technology includes: immersing a fabric in an enzyme solution, steaming (piling up at 100° C. for 20 min), water washing (at 95° C.) and drying. The desizing technology is performed in the presence of a desizing enzyme (3 g/L), a penetrant (4 g/L) and a chelating agent (2 g/L), at a speed of 70 m/min.

The specific flow of the liquid ammonia finishing technology includes: fabric feeding, pre-cure, cooling, liquid ammonia treatment (padding with liquid ammonia for 15 s and drying), steaming (at 95° C.), water washing (at 95° C.), drying and doffing. The liquid ammonia finishing technology is performed at a speed of 60 m/min, a temperature of a treatment chamber of 80° C., and a pH value at doffing of 6.

The specific flow of the mercerizing technology includes: immersing a fabric in an alkaline solution (for 5 min), water washing (with tension applied, at 95° C.), and adjusting the pH value of a neutralizing water washing tank to neutral. The mercerizing technology is performed in the presence of concentrated alkali (239 g/L), at a speed of 70 m/min, the pH value of the neutralizing water washing tank of 4.5, with the width at doffing of 140 cm.

Post-treatment process (post-cure finishing process A): The cotton fabric is placed in a conventional finishing solution for two dips and two nips, and the pick-up rate is 80%. After being padded with the finishing solution, the cotton fabric is pre-cured at 80° C. for 3 min to obtain a delayed-cure sensitized fabric with a moisture regain at doffing of 8%.

Comparative Example 1

A delayed-cure durable press finishing technology for cotton fabrics refers to Example 1, and Comparative Example 1 is different from Example 1 in that:

A pretreatment process includes singeing, desizing, mercerizing and liquid ammonia finishing.

Comparative Example 2

A delayed-cure durable press finishing technology for cotton fabrics refers to Example 1, and Comparative Example 2 is different from Example 1 in that:

A pretreatment process includes singeing, desizing, mercerizing, liquid ammonia finishing and liquid ammonia finishing.

The delayed-cure sensitized fabrics prepared in Example 1 and Comparative Examples 1-2 are stored at 80° C. for 5 d, and tested according to standard AATCC66-2008, standard ASTMD5035-2006 and standard AATCC110-2011 to determine the wrinkle recovery angle, breaking strength and whiteness data of the delayed-cure sensitized fabrics in Example 1 and Comparative Examples 1-2. With the wrinkle recovery angle and breaking strength of the pretreated fabric before the fabric is padded with a finishing solution as reference values, the breaking strength change rate and the wrinkle recovery angle change rate are calculated.

The wrinkle recovery angle change rate W (%) is calculated according to equation (1), and the obtained data is shown in Table 1:

$$W(\%) = \frac{(W_S - W_0)}{W_0} \times 100\% \quad (1)$$

where $W_0$ is the wrinkle recovery angle (°) of the pretreated fabric before the fabric is padded with the finishing solution; and $W_S$ is the wrinkle recovery angle (°) of the delayed-cure sensitized fabric before and after storage.

The breaking strength change rate $T_{SC}$ (%) is calculated according to equation (2) to obtain the absolute value, and the obtained data is shown in Table 2:

$$T_{SC}(\%) = \frac{(T_S - T_{S0})}{T_{S0}} \times 100\% \quad (2)$$

where $T_{S0}$ is the breaking strength (N) of the pretreated fabric before the fabric is padded with the finishing solution; and $T_S$ is the breaking strength (N) of the delayed-cure sensitized fabric before and after storage.

The wrinkle recovery angle and breaking strength of the pretreated fabric before the fabric is padded with the finishing solution in Example 1 are 176.27° and 437.57 N. The wrinkle recovery angle and breaking strength of the pretreated fabric before the fabric is padded with the finishing solution in Comparative Example 1 are 164.5° and 431.3 N. The wrinkle recovery angle and breaking strength of the pretreated fabric before the fabric is padded with the finishing solution in Comparative Example 2 are 167.23° and 439.33 N.

The data obtained by determining the whiteness is shown in Table 3.

TABLE 1

Wrinkle recovery angle change rate (%) data of delayed-cure sensitized fabrics prepared in Example 1 and Comparative Examples 1-2

| | 0 d | 1 d | 2d | 3 d | 4 d | 5 d |
|---|---|---|---|---|---|---|
| Example 1 | 16.58 | 24.18 | 29.22 | 33.89 | 35.95 | 36.57 |
| Comparative Example 1 | 15.67 | 35.97 | 42.77 | 44.24 | 47.49 | 49.77 |
| Comparative Example 2 | 18.12 | 34.91 | 41.59 | 43.36 | 45.08 | 48.62 |

TABLE 2

Breaking strength change rate (%) data of delayed-cure sensitized fabrics prepared in Example 1 and Comparative Examples 1-2

| | 0 d | 1 d | 2d | 3 d | 4 d | 5 d |
|---|---|---|---|---|---|---|
| Example 1 | 9.96 | 10.83 | 13.65 | 14.88 | 15.22 | 16.21 |
| Comparative Example 1 | 4.26 | 13.59 | 16.99 | 19.05 | 21.23 | 22.01 |
| Comparative Example 2 | 6.82 | 9.85 | 13.33 | 15.47 | 17.49 | 18.06 |

TABLE 3

Whiteness data of delayed-cure sensitized fabrics prepared in Example 1 and Comparative Examples 1-2

| | 0 d | 1 d | 2d | 3 d | 4 d | 5 d |
|---|---|---|---|---|---|---|
| Example 1 | 79.59 | 76.89 | 76.66 | 75.02 | 74.78 | 74.56 |
| Comparative Example 1 | 76.55 | 75.02 | 73.99 | 73.96 | 73.22 | 72.37 |
| Comparative Example 2 | 76.21 | 72.06 | 71.88 | 71.01 | 70.98 | 70.06 |

From the above data, namely the wrinkle recovery angle change rate, breaking strength change rate and whiteness data of the delayed-cure sensitized fabrics prepared in Example 1 and Comparative Examples 1-2, the sensitized fabrics prepared in Example 1 has a relatively slowly changing overall breaking strength, a relatively slowly increasing overall wrinkle recovery angle, and always the highest whiteness. After being stored for 5 d, the delayed-cure sensitized fabric prepared in Example 1 has the smallest absolute value of the strength change rate and the smallest wrinkle recovery change rate. Therefore, the delayed-cure sensitized fabric prepared in Example 1 has the optimal stability. The pretreatment technologies provided by the disclosure are well combined. When one process is omitted or the technology sequence is changed, the stability of the prepared delayed-cure sensitized fabric obviously decreases.

Example 2

A Delayed-Cure Fabric, Prepared by a Technology Including Storage and Cure Steps A delayed-cure durable press finishing technology for cotton fabrics includes a pretreatment process and a post-treatment process.

The pretreatment process includes singeing, desizing, liquid ammonia finishing, mercerizing and liquid ammonia finishing.

The specific flow of the desizing technology includes: immersing a fabric in an enzyme solution, steaming (piling up at 100° C. for 20 min), water washing (at 95° C.) and drying. The desizing technology is performed in the presence of a desizing enzyme (3 g/L), a penetrant (4 g/L) and a chelating agent (2 g/L), at a speed of 70 m/min.

The specific flow of the liquid ammonia finishing technology includes: fabric feeding, pre-cure, cooling, liquid ammonia treatment (padding with liquid ammonia for 15 s and drying), steaming (at 95° C.), water washing (at 95° C.), drying and doffing. The liquid ammonia finishing technology is performed at a speed of 60 m/min, a temperature of a treatment chamber of 80° C., and a pH value at doffing of 6.

The specific flow of the mercerizing technology includes: immersing a fabric in an alkaline solution (for 5 min), water washing (with tension applied, at 95° C.), and adjusting the pH value of a neutralizing water washing tank to neutral. The mercerizing technology is performed in the presence of concentrated alkali (239 g/L), at a speed of 70 m/min, the pH value of the neutralizing water washing tank of 4.5, with the width at doffing of 140 cm.

Post-treatment process (post-cure finishing process B): The cotton fabric is placed in a finishing solution for two dips and two nips, and the pick-up rate is 70%-80%. After being padded with the finishing solution, the cotton fabric is pre-cured at 80° C. for 3 min, and then cured at 140° C. for 3 min after storage to obtain a delayed-cure fabric.

Example 3

A delayed-cure durable press finishing technology for cotton fabrics refers to Example 2, and Example 3 is different from Example 2 in that in the post-cure finishing process B, the curing duration is adjusted from 3 min to 6 min.

Example 4

A delayed-cure durable press finishing technology for cotton fabrics refers to Example 2, and Example 4 is different from Example 2 in that in the post-cure finishing process B, the curing duration is adjusted from 3 min to 8 min.

Example 5

A delayed-cure durable press finishing technology for cotton fabrics refers to Example 2, and Example 5 is different from Example 2 in that in the post-cure finishing process B, the curing temperature is adjusted from 140° C. to 150° C.

Example 6

A delayed-cure durable press finishing technology for cotton fabrics refers to Example 2, and Example 6 is different from Example 2 in that in the post-cure finishing process B, the curing temperature is adjusted from 140° C. to 150° C., and the curing duration is adjusted from 3 min to 6 min.

Example 7

A delayed-cure durable press finishing technology for cotton fabrics refers to Example 2, and Example 7 is different from Example 2 in that in the post-cure finishing process B, the curing temperature is adjusted from 140° C. to 150° C., and the curing duration is adjusted from 3 min to 8 min.

Example 8

A delayed-cure durable press finishing technology for cotton fabrics refers to Example 2, and Example 8 is different from Example 2 in that in the post-cure finishing process B, the curing temperature is adjusted from 140° C. to 160° C.

Example 9

A delayed-cure durable press finishing technology for cotton fabrics refers to Example 2, and Example 9 is different from Example 2 in that in the post-cure finishing process B, the curing temperature is adjusted from 140° C. to 160° C., and the curing duration is adjusted from 3 min to 6 min.

Example 10

A delayed-cure durable press finishing technology for cotton fabrics refers to Example 2, and Example 10 is different from Example 2 in that in the post-cure finishing process B, the curing temperature is adjusted from 140° C. to 160° C., and the curing duration is adjusted from 3 min to 8 min.

Comparative Example 3

A liquid ammonia finishing and mercerizing combined finishing cotton fabric treatment technology includes: singeing, desizing, liquid ammonia finishing, mercerizing, liquid ammonia finishing, tentering and pre-shrinking.

The specific flow of the desizing technology includes: immersing a fabric in an enzyme solution, steaming (piling up at 100° C. for 20 min), water washing (at 95° C.) and drying. The desizing technology is performed in the presence of a desizing enzyme (3 g/L), a penetrant (4 g/L) and a chelating agent (2 g/L), at a speed of 70 m/min.

The specific flow of the liquid ammonia finishing technology includes: fabric feeding, pre-cure, cooling, liquid ammonia treatment (padding with liquid ammonia for 15 s and drying), steaming (at 95° C.), water washing (at 95° C.), drying and doffing. The liquid ammonia finishing technology is performed at a speed of 60 m/min, a temperature of a treatment chamber of 80° C., and a pH value at doffing of 6.

The specific flow of the mercerizing technology includes: immersing a fabric in an alkaline solution (for 5 min), water washing (with tension applied, at 95° C.), and adjusting the pH value of a neutralizing water washing tank to neutral. The mercerizing technology is performed in the presence of concentrated alkali (239 g/L), at a speed of 70 m/min, the pH value of the neutralizing water washing tank of 4.5, with the width at doffing of 140 cm.

Comparative Example 4

A delayed-cure durable press finishing technology for cotton fabrics refers to Example 5, and Comparative Example 4 is different from Example 5 in that:

A pretreatment process includes singeing, desizing, mercerizing and liquid ammonia finishing.

Comparative Example 5

A delayed-cure durable press finishing technology for cotton fabrics refers to Example 5, and Comparative Example 5 is different from Example 5 in that:

A pretreatment process includes singeing, desizing, mercerizing, liquid ammonia finishing and liquid ammonia finishing.

The delayed-cure cotton fabrics prepared in Examples 2-10 and Comparative Examples 3-5 are tested according to standard AATCC66-2008, standard ASTMD5035-2006 and standard AATCC110-2011 to determine the wrinkle recovery angle, breaking strength and whiteness data of the cotton fabrics before and after treatment in Examples 2-10 and Comparative Examples 3-5, and the data obtained is shown in Table 4.

TABLE 4

Wrinkle recovery angle, breaking strength and whiteness data of delayed-cure fabrics prepared in Examples 2-10 and Comparative Examples 3-5

| | Wrinkle recovery angle (°) | Breaking strength (N) | Whiteness |
|---|---|---|---|
| Example 2 | 233.50 | 384.02 | 75.41 |
| Example 3 | 245.00 | 379.77 | 74.18 |
| Example 4 | 249.25 | 362.67 | 73.91 |
| Example 5 | 251.73 | 363.95 | 73.85 |
| Example 6 | 256.00 | 359.25 | 73.55 |
| Example 7 | 263.00 | 350.47 | 73.24 |
| Example 8 | 264.68 | 357.79 | 73.01 |
| Example 9 | 262.97 | 351.19 | 71.45 |
| Example 10 | 267.08 | 325.99 | 69.38 |
| Comparative Example 3 | 176.27 | 437.57 | 72.89 |
| Comparative Example 4 | 240.13 | 349.43 | 70.53 |
| Comparative Example 5 | 242.50 | 356.96 | 71.03 |

From the wrinkle recovery angle, breaking strength and whiteness data of the delayed-cure fabrics prepared in Examples 2-10 in Table 4, and combining the wrinkle recovery angle, breaking strength and whiteness data, the delayed-cure fabric treated in Example 8 has the optimal overall performance, so the curing duration of 3 min in Example 8 and the curing temperature of 160° C. in Example 8 are preferable in the disclosure.

From the comparison of the delayed-cure cotton fabric prepared in Example 5 and the wrinkle recovery angle, breaking strength and whiteness data of the cotton fabric prepared in Comparative Example 3 in Table 4, after the pretreatment technology as described in the disclosure is combined with the post-cure finishing, compared with the single pretreatment technology, the wrinkle recovery angle of the fabric is increased by 32.5%, the wrinkle recovery performance is greatly improved, the breaking strength retention rate can reach 87.8%, and the durable press effect is more favorable.

From the wrinkle recovery angle and breaking strength data of the delayed-cure fabrics prepared in Example 5 and Comparative Examples 4-5 in Table 4, the delayed-cure fabric prepared in Example 5 has the optimal performance. The pretreatment technologies provided by the disclosure are well combined. When one process is omitted or the technology sequence is changed, the durable press performance of the prepared fabric after curing obviously decreases.

It should be noted that the above examples are merely for illustrating the technical solution of the disclosure and not to limit the disclosure. Although the disclosure has been described in detail with reference to preferred examples, it will be understood by those of ordinary skill in the art that modifications or equivalent replacements of the technical solution of the disclosure can be made without departing from the spirit and scope of the technical solution of the disclosure, and should be included in the scope of the claims of the disclosure.

What is claimed is:

1. A delayed-cure durable press finishing process for cotton fabrics, which comprises the following steps performed sequentially:

a) providing a fabric, wherein the fabric is comprised of cotton, b) singeing the fabric, c) desizing the fabric, d) conducting a first liquid ammonia finishing at a feed rate of 50 to 60 meters of fabric per minute, at 80° C., and at a pH of 6, which comprises: i) curing the fabric, ii) cooling the fabric, iii) performing a liquid ammonia treatment, iv) steaming the fabric at 90° C. to 100° C., v) washing the fabric in water with applied tension at 90° C. to 100° C., and vi) drying the fabric, e) mercerizing the fabric at a feed rate of 60 to 70 meters of the fabric per minute, which comprises: immersing the fabric in an alkaline solution for 4 to 6 minutes, then washing the fabric at 90° C. to 100° C. at a pH of 4.5 to 5.0, and then adjusting the pH to neutral, f) conducting a second liquid ammonia finishing at a feed rate of 50 to 60 meters of fabric per minute, at 80° C., and at a pH of 6, which comprises: i) curing the fabric, ii) cooling the fabric, iii) performing a liquid ammonia treatment, iv) steaming the fabric at 90° C. to 100° C., v) washing the fabric in water with applied tension at 90° C. to 100° C., and vi) drying the fabric, and g) post-cure finishing the fabric, which comprises: padding the fabric in a double-dip-double-nip method at a fabric pick up rate of 70% to 90%, and curing the fabric at 80° C. to 85° C. for 2 to 3 minutes to obtain a delayed-cure sensitized fabric having a moisture regain at doffing of 7% to 9%.

2. The delayed-cure durable press finishing process of claim 1, wherein the desizing step c) comprises:

immersing the fabric in an enzyme solution, steaming the fabric, washing the fabric in water, and then drying the fabric;

wherein the steaming performed at 100° C. for 20 minutes; and wherein the washing temperature is 90° C. to 100° C.

3. The delayed-cure durable press finishing process of claim 2, wherein the enzyme solution comprises 3 g/L of a desizing enzyme, 4 g/L of a penetrant, and 2 g/L of a chelating agent.

* * * * *